US006606879B1

(12) United States Patent
Telesz

(10) Patent No.: US 6,606,879 B1
(45) Date of Patent: Aug. 19, 2003

(54) ACCUMULATOR ASSEMBLY HAVING A REVERSING VALVE AND A HEAT PUMP SYSTEM THEREOF

(75) Inventor: John Paul Telesz, East Amherst, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/151,429

(22) Filed: May 20, 2002

(51) Int. Cl.[7] ..... F25B 13/00; F25B 43/00
(52) U.S. Cl. ..... 62/324.6; 62/503; 62/512
(58) Field of Search ..... 62/512, 324.6, 62/503; 137/119.02

(56) References Cited

U.S. PATENT DOCUMENTS 5,052,193 A 10/1991 Pettitt et al. ..... 62/503
5,201,195 A 4/1993 Gaviak et al. ..... 62/475
5,309,731 A * 5/1994 Nonoyama et al. ..... 62/244
6,189,325 B1 * 2/2001 Pittion et al. ..... 62/176.3
6,192,700 B1 * 2/2001 Runk et al. ..... 62/228.5
6,237,351 B1 * 5/2001 Itoh et al. ..... 62/196.3
6,293,123 B1 * 9/2001 Iritani et al. ..... 62/409
6,347,528 B1 * 2/2002 Iritani et al. ..... 62/324.6

* cited by examiner

*Primary Examiner*—William C. Doerrler
*Assistant Examiner*—Mark Shulman
(74) *Attorney, Agent, or Firm*—Patrick M. Griffin

(57) ABSTRACT

An accumulator for use in a heat pump system accommodates the flow of refrigerant in first and second directions as the system heats and cools, respectively. The accumulator includes a body and a cap. The body includes an inlet for receiving refrigerant from a compressor and an outlet for sending refrigerant to the compressor. A first port communicates with a front end heat exchanger for receiving refrigerant from this heat exchanger when heating and for sending refrigerant to this heat exchanger when cooling. A second port communicates with a passenger compartment heat exchanger for sending refrigerant to this heat exchanger when heating and for receiving refrigerant from this heat exchanger when cooling. A reversing valve, disposed in the cap, moves between a first position when heating and a second position when cooling such that the accumulator can accommodate the flow of refrigerant in the either direction.

22 Claims, 3 Drawing Sheets

ACCUMULATOR ASSEMBLY HAVING A REVERSING VALVE AND A HEAT PUMP SYSTEM THEREOF

TECHNICAL FIELD

The subject invention generally relates to an accumulator assembly for use in a heat pump system that is selectively operable in a heating mode and in a cooling mode. More specifically, the subject invention relates to an accumulator assembly that includes a reversing valve to accommodate the flow of refrigerant in one direction, which is associated with the heating mode of the heat pump system, and to accommodate the flow of the refrigerant in an opposite direction, which is associated with the cooling mode of the heat pump system.

BACKGROUND OF THE INVENTION

Heat pump systems are known in the art. Heat pump systems are selectively operable in a heating mode to heat a particular area, such as a room or a passenger compartment of a motor vehicle, and in a cooling mode to cool the area.

Conventional heat pump systems include a refrigerant compressor, a front end heat exchanger, a passenger compartment heat exchanger, an accumulator, and a reversing valve. As appreciated by those skilled in the art, the accumulator is typically an accumulator/dehydrator. The reversing valve directs, or controls, a flow of refrigerant throughout the heat pump system depending on whether the heat pump system is in the heating mode or in the cooling mode. More specifically, in the heating mode, the reversing valve directs the flow of the refrigerant throughout the heat pump system in a first direction, and in the cooling mode, the reversing valve directs the flow of the refrigerant throughout the heat pump system in a second direction, which is generally the opposite of the first direction of flow.

As shown in FIG. 1, which represents the heat pump systems of the prior art, the accumulator and the reversing valve are distinct components. That is, the reversing valve is not integral to, i.e., one component with, the accumulator. Because the accumulator and reversing valve are distinct components, i.e., because the reversing valve is not integrated into the accumulator, the heat pump systems of the prior art are unable to accommodate the flow refrigerant in both the first and second directions without the separate reversing valve.

With the separate reversing valve, the heat pump systems of the prior art are deficient for several reasons. For instance, any plumping requirements for the heat pump system are particularly complex due to the additional and separate componentry of the reversing valve. With the separate reversing valve, the heat pump systems of the prior art require additional plumbing connections and, as is known throughout the art, the more plumbing connections throughout a heat pump system, the greater the likelihood of failure throughout the system, i.e., reliability of the system is effected due to the increased plumbing connections. Furthermore, with the accumulator and the reversing valve as separate components, the overall mass of the heat pump system is increased and the overall packaging for the heat pump system is unnecessarily complex. Finally, service of the heat pump system is complex as both the accumulator and the reversing valve may require service.

Due to the inadequacies of the prior art heat pump systems, including those described above, it is desirable to provide an accumulator for use in a heat pump system that includes, i.e., integrates, a reversing valve in the accumulator such that the accumulator can accommodate the flow of the refrigerant in both the first and second directions of refrigerant flow.

SUMMARY OF THE INVENTION

An accumulator assembly for use in a heat pump system is disclosed. The heat pump system includes a refrigerant compressor, a front end heat exchanger, and a passenger compartment heat exchanger. The heat pump system is selectively operable in a heating mode and in a cooling mode. In the heating mode, refrigerant flows through the system in a first direction, and in the cooling mode, the refrigerant flows through the system in the second direction. The accumulator assembly of the subject invention accommodates the flow of the refrigerant through the system in either the first or second direction.

The accumulator assembly of the subject invention includes a body housing and a cap housing covering the body housing. The body housing includes an accumulator inlet for receiving the refrigerant from the compressor and an accumulator outlet for sending the refrigerant to the compressor. The accumulator assembly further includes a first and second refrigerant port.

The first refrigerant port is defined within one of the body and cap housings. Moreover, the first refrigerant port is in fluid communication with the front end heat exchanger. As such, the first refrigerant port receives the refrigerant from the front end heat exchanger in the heating mode and sends the refrigerant to the front end heat exchanger in the cooling mode. As with the first refrigerant port, the second refrigerant port is also defined with one of the body and cap housings. The second refrigerant port is in fluid communication with the passenger compartment heat exchanger. As such, the second refrigerant port sends the refrigerant to the passenger compartment heat exchanger in the heating mode and receives the refrigerant from the passenger compartment heat exchanger in the cooling mode.

A reversing valve is disposed in the cap housing. The reversing valve is moveable within the cap housing between a first position and a second position. The first position of the reversing valve is associated with the heating mode, and the second position of the reversing valve is associated with the cooling mode. In the first position, the first refrigerant port is isolated from the accumulator inlet such that the refrigerant from the compressor flows in the first direction to the passenger compartment heat exchanger first and then through the front end heat exchanger. In the second position, the first refrigerant port is in fluid communication with the accumulator inlet such that the refrigerant from the compressor flows in the second direction to the front end heat exchanger first and then through the passenger compartment heat exchanger. With the first and second positions, the reversing valve is able to accommodate the flow of the refrigerant in either the first or second direction.

Accordingly, the subject invention provides an accumulator assembly for use in a heat pump system. More specifically, this accumulator assembly includes a reversing valve to accommodate the flow of the refrigerant in either the first or second direction.

The accumulator assembly simplifies the plumbing requirements throughout the heat pump system by eliminating the separate componentry of a distinct reversing valve. The plumbing requirements are simplified by reducing the total number of plumbing. connections required. With less plumbing connections required, the likelihood of failure throughout the system is minimized relative to prior art heat pump systems, and overall reliability of the accumulator assembly and heat pump system of the subject invention is enhanced. Without the reversing valve integrated into the accumulator, the overall mass of the heat pump system of the subject invention is decreased relative to the prior art heat pump systems, and the overall packing for this heat pump system is simplified. Finally, the heat pump system of the subject invention may be more easily serviced at one location in the system, i.e., at the accumulator assembly with the reversing valve, rather than at both a reversing valve and at a separate accumulator.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Referring to the Figures, wherein like numerals indicate like or corresponding parts throughout the several views, an accumulator assembly is generally disclosed at 10. For descriptive purposes, the accumulator assembly 10 of the subject invention is hereinafter referred to as the accumulator 10. Also, it is to be understood that a desiccant. 11 (see FIG. 5) may be disposed in the accumulator 10 for dehydrating refrigerant flowing in and through the accumulator 10. If desiccant 11 is included, then the accumulator 10 is commonly referred to in the art as an accumulator/dehydrator (AID). As disclosed particularly in FIGS. 2–3, the accumulator 10 is used in a heat pump system, which is generally indicated at 12.

Figure 2:
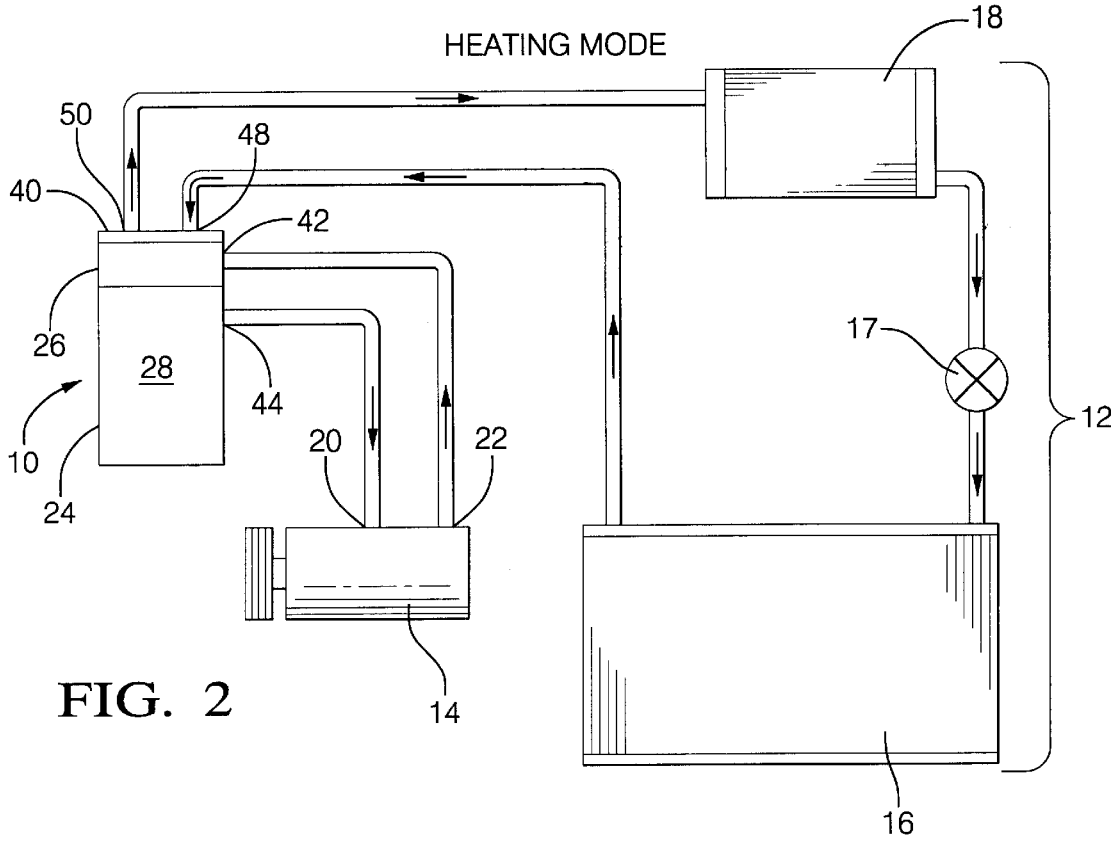
FIG. 2 is a schematic view of a heat pump system of the subject invention illustrating an accumulator assembly having a reversing valve where the heat pump system is in a heating mode.
Figure 3:
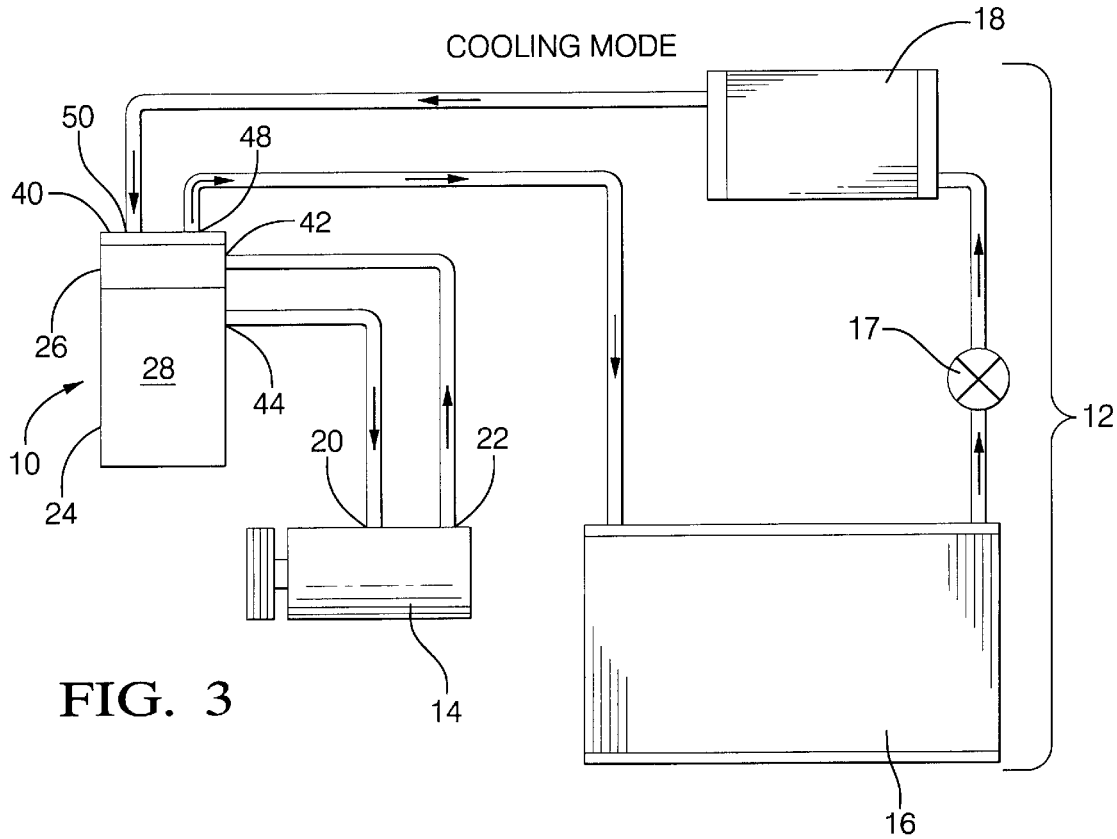
FIG. 3 is a schematic view of the heat pump system of FIG. 2 in a cooling mode.

Referring to FIGS. 2–3, in addition to the accumulator 10, the heat pump system 12 includes a refrigerant compressor 14, a front end heat exchanger 16, and a passenger compartment heat exchanger 18. The front end heat exchanger 16 is frequently referred to in the art as an outside heat exchanger, and the passenger compartment heat exchanger 18 is frequently referred to in the art as an inside, or cabin, heat exchanger. Although not required for the instant invention, the heat pump system 12 may also include an expansion tube 17 disposed between the front end heat exchanger 16 and the passenger compartment heat exchanger 18.

The heat pump system 12 of the subject invention is selectively operable in a heating mode to heat a particular area and in a cooling mode to cool the cool the area. The selective operability of the accumulator 10 and of the heat pump system 12 of the subject invention enable the flow of the refrigerant to be reversed between a first and a second direction as described below. In the heating mode, the refrigerant flows through the system 12 in the first direction, and in the cooling mode, the refrigerant flows through the system 12 in the second direction. Although the instant description is targeted at a passenger compartment of a motor vehicle as the particular area to be heated or cooled, it is to be understood that the subject invention is not limited to motor vehicles. That is, the heat pump system 12, including the accumulator 10, of the subject invention may be used to heat and/or cool other areas such as houses, commercial buildings, and the like.

The heating mode for the heat pump system 12 is schematically represented in FIG. 2, and the cooling mode for the heat pump system 12 is schematically represented in FIG. 3. Both the front end heat exchanger 16 and the passenger compartment heat exchanger 18 are in fluid communication with the compressor 14. The front end heat exchanger 16 transfers heat to the refrigerant to cool air in the heating mode, and removes heat from the refrigerant to condense the refrigerant in the cooling mode. On the other hand, the passenger compartment heat exchanger 18 transfers heat to the refrigerant to cool the air in the cooling mode, and removes heat from the refrigerant to condense the refrigerant in the heating mode. The accumulator 10 of the present invention, and therefore the heat pump system 12 of the present invention, which includes the accumulator 10, accommodates the flow of the refrigerant through the system 12 in either direction.

As understood by those skilled in the art, the compressor 14 has a compressor inlet 20, i.e., the suction side, and a compressor outlet 22, i.e., the discharge side. Furthermore, it is understood that various refrigerant tubes, or hoses, disclosed but not numbered throughout the Figures, are connected to and between the various components of the heat pump system 12 to accommodate the flow of the refrigerant between the components. It is to be understood that FIGS. 2 and 3 are schematic representations of the accumulator 10 and the heat pump system 12 of the subject invention. Therefore, these Figures are not to be interpreted as limiting as to the orientations and connections of the various refrigerant tubes to the components in the heat pump system 12.

Referring particularly to FIGS. 4–7, the accumulator 10 includes a body housing 24 and a cap housing 26. The body housing 24 and the cap housing 26 are also referred to in the art as canisters. The body housing 24 defines a reservoir 28 for the refrigerant. The cap housing 26 covers the body housing 24. In one manner of description, the body housing 24 and the cap housing 26 are disposed between the compressor 14 and the front end heat exchanger 16, and in another manner of description, the body housing 24 and the cap housing 26 are disposed between the compressor 14 and the passenger compartment heat exchanger 18. In this location, the body housing 24 and the cap housing 26 can accommodate the flow of the refrigerant through the system 12 in either the first or second direction.

The cap housing 26 includes a first end 30, a second end 32 and an interior wall 34. The interior wall 34 of the cap housing 26 defines a fluid chamber 36 between the first and second ends 30, 32. A fluid chamber outlet 38 is defined within the interior wall 34 of the cap housing 26. The fluid chamber outlet 38 accommodates the flow of the refrigerant from the fluid chamber 36 into the reservoir 28.

It is to be understood that the body housing 24 and the cap housing 26 may be integral, i.e., one piece, or the body housing 24 and the cap housing 26 may be two separate pieces with the cap housing 26 somehow mounted to the body housing 24. In the preferred embodiment of the subject invention, the body housing 24 and the cap housing 26 are one piece. It is also preferred that the cap housing 26 is impact formed to providing a protective housing for a reversing valve 40 that is incorporated into the accumulator 10. The reversing valve 40 is described below.

The body housing 24 includes an accumulator inlet 42 and an accumulator outlet 44. The accumulator inlet 42 receives the refrigerant from the compressor 14, and the accumulator outlet 44 sends the refrigerant to the compressor 14. The accumulator inlet 42 and the accumulator outlet 44 are in fluid communication with the fluid chamber 36 of the cap housing 26.

Figure 5:
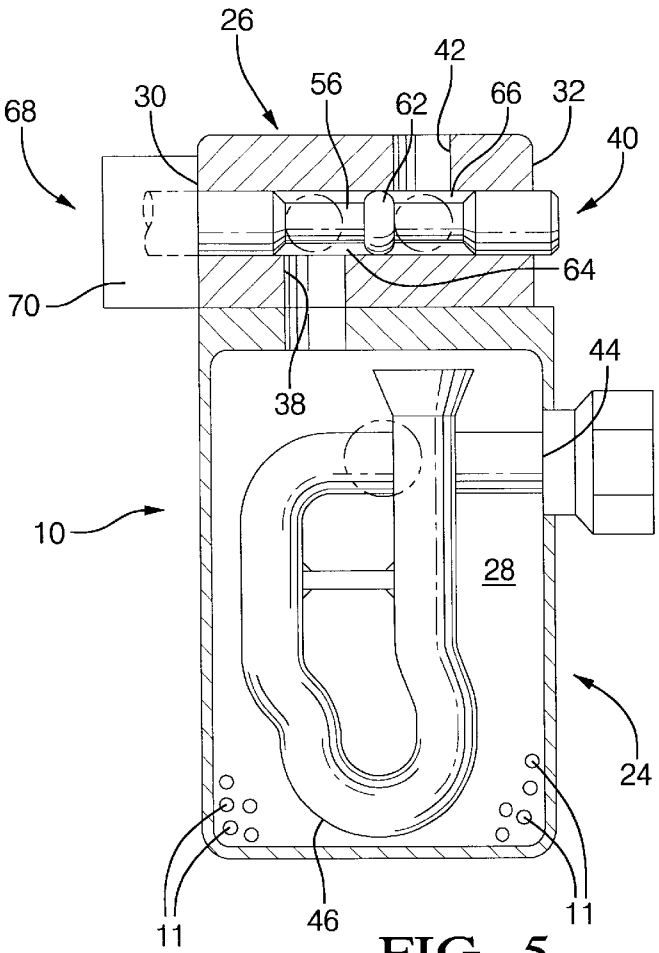
FIG. 5 is a partially cross-sectional side view of the accumulator assembly of the subject invention having the reversing valve integral therewith.

As shown in FIG. 5, the desiccant 11, if included, is preferably disposed in the body housing 24. More specifically, the desiccant is preferably disposed in the reservoir 28 defined by the body housing 24. The desiccant is preferably a desiccant bag or a desiccant cartridge disposed in the reservoir 28. A tube 46, referred to in the art as a trumpet tube, is disposed within the reservoir 28 of the body housing 24. The tube 46 accommodates the flow of the refrigerant from the fluid chamber 36, through the fluid chamber outlet 38, through the tube 46, to the accumulator outlet 44, and to the compressor 14. A venturi tube may be disposed within the reservoir 28 and used as an alternative to the trumpet tube.

The accumulator 10 further includes a first refrigerant port 48 and a second refrigerant port 50. The first refrigerant port 48 is defined within one of the body and cap housings 24, 26. That is, the first refrigerant port 48 can be defined within either the body or the cap housing 24, 26. In the preferred embodiment of the subject invention, the first refrigerant port 48 is defined in the cap housing 26. The first refrigerant port 48 is in fluid communication with the fluid chamber 36 of the cap housing 26. The first refrigerant port 48 is also in fluid communication with the front end heat exchanger 16. As a result, in the heating mode, the first refrigerant port 48 receives the refrigerant from the front end heat exchanger 16, and in the cooling mode, the first refrigerant port 48 is for sending the refrigerant to the front end heat exchanger 16.

Like the first refrigerant port 48, the second refrigerant port 50 is also defined within one of the body and cap housings 24, 26. Preferably, the second refrigerant port 50 is defined within the body housing 24. The second refrigerant port 50 is in fluid communication with the fluid chamber 36 of the cap housing 26. The second refrigerant port 50 is also in fluid communication with the passenger compartment heat exchanger 18. As a result, in the heating mode, the second refrigerant port 50 is for sending the refrigerant to the passenger compartment heat exchanger 18, and in the cooling mode, the second refrigerant port 50 receives the refrigerant from the passenger compartment heat exchanger 18.

Figure 7:
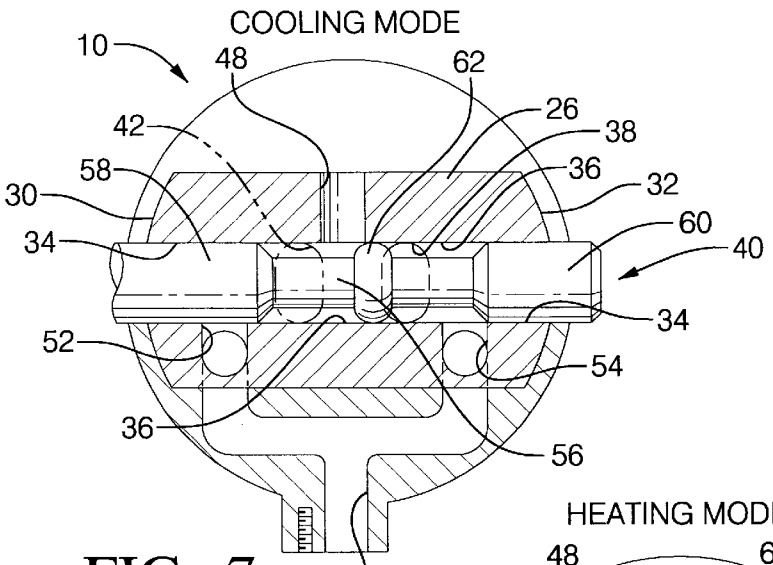
FIG. 7 is a partially cross-sectional top view of the accumulator assembly of the subject invention illustrating the cap housing of the assembly and a second position of the reversing valve when the heat pump system is in the cooling mode.
Figure 6:
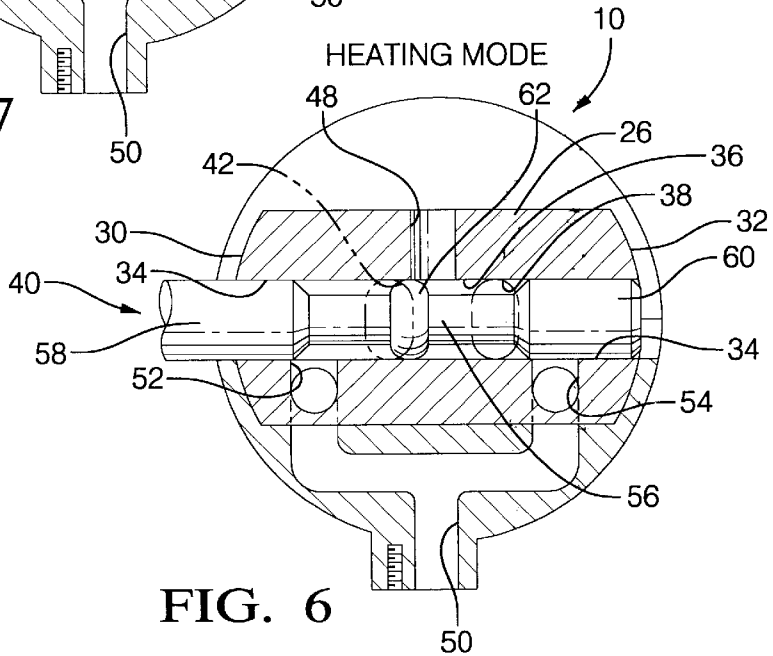
FIG. 6 is a partially cross-sectional top view of the accumulator assembly of the subject invention illustrating a cap housing of the assembly and a first position of the reversing valve when the heat pump system is in the heating mode.

The second refrigerant port 50 includes an outlet portion 52 and an inlet portion 54. The outlet and inlet portions 52, 54 are not differentiated in the schematic representations of FIGS. 2 and 3. Referring particularly to FIGS. 6 and 7, the outlet portion 52 and the inlet portion 54 are in fluid communication with the fluid chamber 36. As such, in the heating mode, the outlet portion 52 of the second refrigerant port 50 accommodates the flow of the refrigerant from the compressor 14, through the accumulator inlet 42, through the fluid chamber 36, and to the passenger compartment heat exchanger 18. As described below, the inlet portion 54 is blocked in the heating mode. On the other hand, in the cooling mode, the inlet portion 54 of the second refrigerant port 50 accommodates the flow of the refrigerant from the passenger compartment heat exchanger 18 into the fluid chamber 36 where the. refrigerant is ultimately returned to the compressor 14. As described below, the outlet portion 52 is blocked in the cooling mode.

The accumulator 10 of the subject invention includes the reversing valve 40. The reversing valve 40 is disposed in the cap housing 26. As a result, the reversing valve 40 is integral, i.e., one, with the accumulator 10. The reversing valve 40 is best disclosed in FIGS. 6 and 7. In FIGS. 2 and 3, the reversing valve 40 is only schematically represented. Although not required, the reversing valve 40 is preferably a barrel valve. The barrel valve, not numbered, is the particular type of reversing valve 40 disclosed throughout the Figures. It is to be understood that other valve types may be suitable for the reversing valve 40 provided the valve type is suitable for satisfying the functionality below.

The reversing valve 40 is moveable within the cap housing 26 between a first position and a second position. The first and second positions for the reversing valve 40 enable the heat pump system 12, having the accumulator 10 of the subject invention, to instantly cool or to instantly heat the passenger compartment of the motor vehicle. As such, no waiting period is required to heat the passenger compartment. That is, one does not need to wait for an engine of the motor vehicle to 'warm-up'to provide adequate heat to the passenger compartment. This characteristic is particularly useful in winter, or during other cold periods, when instant heat is desired in the passenger compartment. Of course, in summer, the cooling mode will be predominantly selected. That is, the reversing valve 40 will be selected for movement into the second position.

As disclosed by the differences between FIGS. 6 and 7, the reversing valve 40, in the preferred embodiment, is laterally displaced within the fluid chamber 36 between the first and second ends 30, 32 of the cap housing 26 when moving between the first and second positions. The first and second positions of the reversing valve 40 are represented in FIGS. 6 and 7, respectively. The first position of the reversing valve 40 is associated with the heating mode and the second position of the reversing valve 40 is associated with the cooling mode. More specifically, in the first position, i.e., when the heat pump system 12 is in the heating mode, the first refrigerant port 48 is isolated from the accumulator inlet 42. As such, the refrigerant from the compressor 14 flows in the first direction to the passenger compartment heat exchanger 18 first and then through the front end heat exchanger 16. In the second position, i.e., when the heat pump system 12 is in the cooling mode, the first refrigerant port 48 is in fluid communication with the accumulator inlet 42. As such, the refrigerant from the compressor 14 flows in the second direction to the front end heat exchanger 16 first and then through the passenger compartment heat exchanger 18.

The reversing valve 40 includes an operating shaft 56. The operating shaft 56 is at least partially disposed in the fluid chamber 36. The operating shaft 56 comprises a length, a circumference, and first and second base portions 58, 60, respectively, at opposite ends of the length of the operating shaft 56. The length, circumference, and ends of the operating shaft 56 are disclosed, but not numbered, throughout the Figures. When the operating shaft 56 is in the first position, as disclosed in FIG. 6, the second base portion 60 blocks the inlet portion 54 of the second refrigerant port 50. As a result, refrigerant cannot flow into the fluid chamber 36 through the inlet portion 54. On the other hand, when the operating shaft 56 is in the second position, as disclosed in FIG. 7, the first base portion 58 blocks the outlet portion 52 of the second refrigerant port 50. As a result, refrigerant cannot flow from the fluid chamber 36 through outlet portion 52.

The operating shaft 56 is moveable in the fluid chamber 36. More specifically, the operating shaft 56 is moveable in the fluid chamber 36 into the first position to isolate the first refrigerant port 48 from the accumulator inlet 42 in the heating mode, and the operating shaft 56 is moveable in the fluid chamber 36 into the second position to allow the first refrigerant port 48 to communicate with the accumulator inlet 42 in the cooling mode.

To effectively isolate the first refrigerant port 48 from the accumulator inlet 42 in the heating mode, i.e., when the operating shaft 56 is in the first position, at least one isolation rim 62 is disposed about the circumference of the operating shaft 56. The isolation rim 62 extends outwardly from the circumference to the interior wall 34 of the cap housing 26 thereby segregating the fluid chamber 36 of the cap housing 26. As disclosed in the Figures, the preferred embodiment includes one isolation rim 62. Of course, it is to be understood that more than one isolation rim 62 may be disposed about the circumference of the operating shaft 56 to appropriately segregate the fluid chamber 36 depending on such factors as the position of the accumulator inlet and outlet 42, 44, and of the first and second refrigerant ports 48, 50 relative to the fluid chamber 36. Although not required, a seal, such as an O-ring, may be disposed about the isolation rim 62 to enhance the sealing interface between the isolation rim 62 and the interior wall 34 of the cap housing 26.

The subject invention further includes first and second fluid passages 64, 66. The first fluid passage 64 is defined between the first base portion 58 and the isolation rim 62, and the second fluid passage 66 is defined between the isolation rim 62 and the second base portion 60. In the first position of the operating shaft 56, the first fluid passage 64 accommodates the flow of the refrigerant from the compressor 14, through the accumulator inlet 42, through the fluid chamber 36, through the outlet portion 52 of the second refrigerant port 50, and to the passenger compartment heat exchanger 18. Also in the first position, the second fluid passage 66 accommodates the flow of the refrigerant from the front end heat exchanger 16, through the first refrigerant port 48, through the fluid chamber 36, through the accumulator outlet 44, and to the compressor 14.

On the other hand, in the second position of the operating shaft 56, the first fluid passage 64 accommodates the flow of the refrigerant from the compressor 14, through the accumulator inlet 42, through the fluid chamber 36, through the first refrigerant port 48, and to the front end heat exchanger 16. Also in the second position, the second fluid passage 66 accommodates the flow of the refrigerant from the passenger compartment heat exchanger 18, through the inlet portion 54 of the second refrigerant port 50, through the fluid chamber 36, through the accumulator outlet 44, and to the compressor 14.

Figure 4:
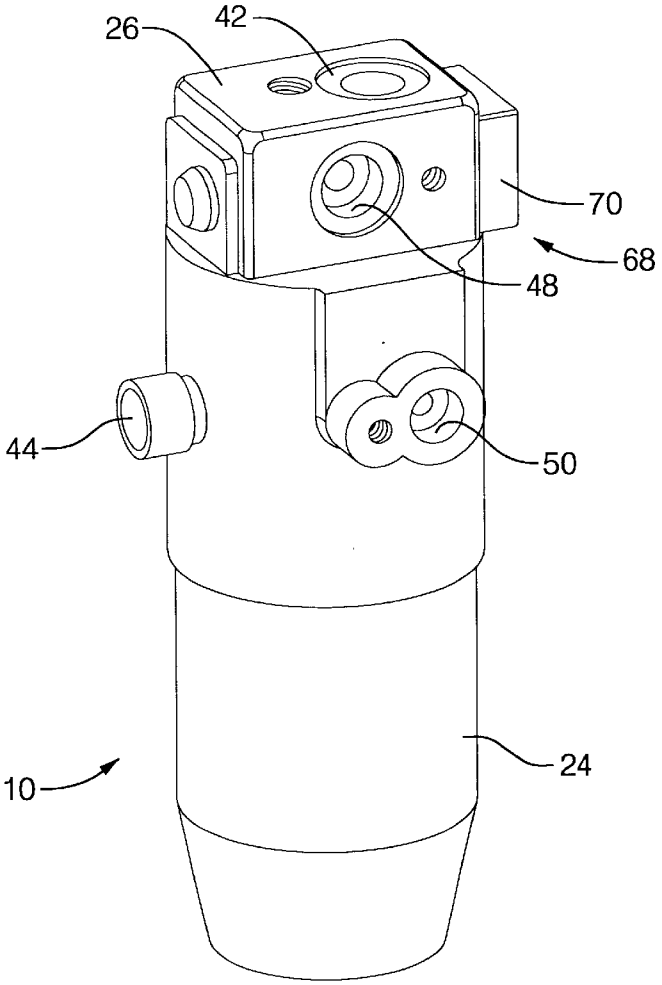
FIG. 4 is a perspective view of the accumulator assembly of the subject invention having the reversing valve integral therewith.
Figure 1:
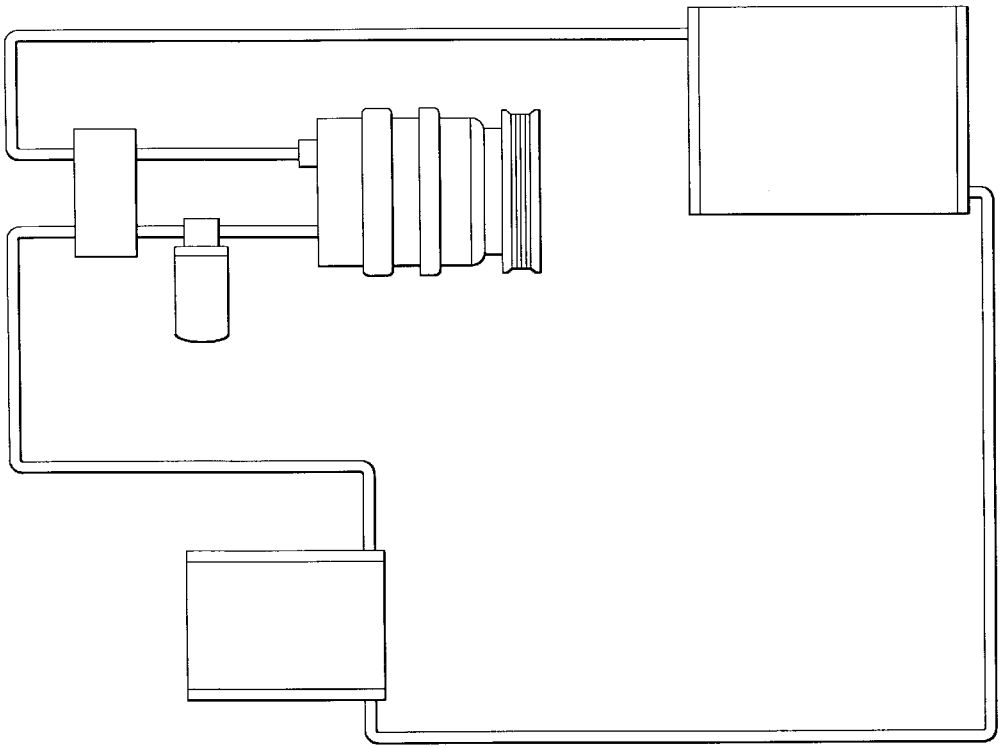
PRIOR ART FIG. 1
FIG. 1 is a schematic view of a prior art heat pump system having a refrigerant compressor, a front end heat exchanger, a passenger compartment heat exchanger, an accumulator, and a reversing valve separate from the accumulator.

Referring to FIGS. 4–5, the accumulator 10 further includes an actuation mechanism 68. In the most preferred embodiment of the subject invention the actuation mechanism 68 is an electric motor 70 that engages the reversing valve 40 for moving the reversing valve 40 between the first and second positions. The electric motor 70 is represented generically in FIGS. 4 and 5. Of course, it is to be understood that the electric motor 70 includes an output shaft, not shown in the Figures, that engages the reversing valve 40 for moving the reversing valve 40 between the first and second positions.

The actuation mechanism 68 is disposed adjacent the cap housing 26 for moving the reversing valve 40 between the first and second positions. More specifically, the actuation mechanism 68 is disposed adjacent one of the first and second ends 30, 32 of the cap housing 26 for moving the operating shaft 56 between the first and second positions. Preferably, the actuation mechanism 68 is disposed adjacent, and actually mounted to, the first end 30 of the cap housing 26 (see FIG. 5). However, the actuation mechanism 68 may be mounted to the second end 32 of the cap housing 26, as disclosed in FIG. 4. If the actuation mechanism 68 is the electric motor 70, then the electric motor 70 engages the operating shaft 56 for moving the operating shaft 56 between the first and second positions. Alternative actuation mechanism 68 may be utilized. These alternative actuation mechanism 68s include, but are not limited to, springs, gears, and a vacuum.

The accumulator 10 of the subject invention may also be used in combination with a pressure equalization hole (PEH) to eliminate liquid siphoning. Further, the accumulator 10 of the subject invention may be used in combination with an oil return mechanism, i.e., oil return circuitry. If the oil return mechanism is included, and the tube 46 is the trumpet tube, then the oil return mechanism relies on a bleed hole at, or near, a bottom of the trumpet tube, and if the tube 46 is the alternative venturi tube, then the oil return mechanism relies on a pick-up tube in the accumulator 10.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. An accumulator assembly for use in a heat pump system which includes a refrigerant compressor, a front end heat exchanger, and a passenger compartment heat exchanger, the heat pump system being selectively operable in a heating mode, where refrigerant flows through the system in a first direction, and in a cooling mode, where the refrigerant flows through the system in a second direction, said accumulator assembly accommodating the flow of the refrigerant through the system in either direction and comprising:

a body housing comprising an accumulator inlet for receiving the refrigerant from the compressor and an accumulator outlet for sending the refrigerant to the compressor;

a cap housing covering said body housing;

a first refrigerant port defined within one of said body and cap housings, said first refrigerant port adapted to be in fluid communication with the front end heat exchanger for receiving the refrigerant from the front end heat exchanger in the heating mode and for sending the refrigerant to the front end heat exchanger in the cooling mode;

a second refrigerant port defined with one of said body and cap housings, said second refrigerant port adapted to be in fluid communication with the passenger compartment heat exchanger for sending the refrigerant to the passenger compartment heat exchanger in the heating mode and for receiving the refrigerant from the passenger compartment heat exchanger in the cooling mode; and a reversing valve disposed in said cap housing and being moveable therein between a first position associated with the heating mode where said first refrigerant port is isolated from said accumulator inlet such that the refrigerant from the compressor flows in the first direction to the passenger compartment heat exchanger first and then through the front end heat exchanger, and a second position associated with the cooling mode where said first refrigerant port is in fluid communication with said accumulator inlet such that the refrigerant from the compressor flows in the second direction to the front end heat exchanger first and then through the passenger compartment heat exchanger.

2. An accumulator assembly as set forth in claim 1 wherein said cap housing comprises a first end, a second end, and an interior wall defining a fluid chamber between said first and second ends.

3. An accumulator assembly as set forth in claim 2 wherein said accumulator inlet and outlet, and said first and second refrigerant ports are in fluid communication with said fluid chamber of said cap housing.

4. An accumulator assembly as set forth in claim 3 wherein said second refrigerant port, comprises an outlet portion in fluid communication with said fluid chamber for accommodating the flow of the refrigerant from the compressor, through said accumulator inlet, through said fluid chamber, and to the passenger compartment heat exchanger in the heating mode, and an inlet portion in fluid communication with said fluid chamber for accommodating the flow of the refrigerant from the passenger compartment heat exchanger into said fluid chamber in the cooling mode.

5. An accumulator assembly as set forth in claim 4 wherein said reversing valve is further defined as a barrel valve.

6. An accumulator assembly as set forth in claim 4 wherein said reversing valve comprises an operating shaft at least partially disposed in said fluid chamber and being moveable therein into said first position to isolate said first refrigerant port from said accumulator inlet in the heating mode, and being moveable therein into said second position to allow said first refrigerant port to communicate with said accumulator inlet in said cooling mode.

7. An accumulator assembly as set forth in claim 6 wherein said operating shaft comprises a length, a circumference, and first and second base portions at opposite ends of said length.

8. An accumulator assembly as set forth in claim 7 wherein said second base portion of said operating shaft blocks said inlet portion of said second refrigerant port when said operating shaft is in said first position, and wherein said first base portion of said operating shaft blocks said outlet portion of said second refrigerant port when said operating shaft is in said second position.

9. An accumulator assembly as set forth in claim 7 further comprising at least one isolation rim disposed about said circumference of said operating shaft, said isolation rim extending outwardly from said circumference to said interior wall of said cap housing for segregating said fluid chamber of said cap housing.

10. An accumulator assembly as set forth in claim 9 wherein said isolation rim isolates said first refrigerant port from said accumulator inlet when said operating shaft is in said first position.

11. An accumulator assembly as set forth in claim 9 further comprising a first fluid passage defined between said first base portion and said isolation rim, and a second fluid passage defined between said isolation rim and said second base portion.

12. An accumulator assembly as set forth in claim 11 wherein, in said first position of said operating shaft, said first fluid passage accommodates the flow of the refrigerant from the compressor, through said accumulator inlet, through said fluid chamber, through said outlet portion of said second refrigerant port, and to the passenger compartment heat exchanger, and said second fluid passage accommodates the flow of the refrigerant from the front end heat exchanger, through said first refrigerant port, through said fluid chamber, through said accumulator outlet, and to the compressor.

13. An accumulator assembly as set forth in claim 12 wherein, in said second position of said operating shaft, said first fluid passage accommodates the flow of the refrigerant from the compressor, through said accumulator inlet, through said fluid chamber, through said first refrigerant port, and to the front end heat exchanger, and said second fluid passage accommodates the flow of the refrigerant from the passenger compartment heat exchanger, through said inlet portion of said second refrigerant port, through said fluid chamber, through said accumulator outlet, and to the compressor.

14. An accumulator assembly as set forth in claim 2 wherein said body housing defines a reservoir for the refrigerant and said accumulator assembly further comprises a fluid chamber outlet defined within said interior wall of said cap housing for accommodating the flow of the refrigerant from said fluid chamber into said reservoir.

15. An accumulator assembly as set forth in claim 14 further comprising a tube disposed within said reservoir of said body housing for accommodating the flow of the refrigerant from said fluid chamber, through said fluid chamber outlet, to said accumulator outlet, and to the compressor.

16. An accumulator assembly as set forth in claim 6 further comprising an actuation mechanism disposed adjacent one of said first and second ends of said cap housing for moving said operating shaft between said first and second positions.

17. An accumulator assembly as set forth in claim 16 wherein said actuation mechanism is mounted to said first end of said cap housing.

18. An accumulator assembly as set forth in claim 16 wherein said actuation mechanism is further defined as an electric motor that engages said operating shaft for moving said operating shaft between said first and second positions.

19. An accumulator assembly as set forth in claim 1 further comprising an actuation mechanism disposed adjacent said cap housing for moving said reversing valve between said first and second positions.

20. An accumulator assembly as set forth in claim 2 wherein said reversing valve is laterally displaced within said fluid chamber between said first and second ends of said cap housing when moving between said first and second positions.

21. An accumulator assembly as set forth in claim 1 further comprising a desiccant disposed in said body housing for dehydrating the refrigerant.

22. A heat pump system operable in a heating mode, where refrigerant flows through the system in a first direction, and in a cooling mode, where the refrigerant flows through the system in a second direction, said system comprising:

a refrigerant compressor;

a front end heat exchanger in fluid communication with said compressor, said front end heat exchanger transferring heat to the refrigerant to cool air in the heating mode, and removing heat from the refrigerant to condense the refrigerant in the cooling mode;

a passenger compartment heat exchanger in fluid communication with said compressor, said passenger compartment heat exchanger transferring heat to the refrigerant to cool the air in the cooling mode, and removing heat from the refrigerant to condense the refrigerant in the heating mode;

a body housing disposed between said compressor and said front end heat exchanger and between said compressor and said passenger compartment heat exchanger for accommodating the flow of the refrigerant through said system in either direction, said body housing comprising an accumulator inlet for receiving the refrigerant from said compressor and an accumulator outlet for sending the refrigerant to said compressor;

a cap housing covering said body housing;

a first refrigerant port defined within one of said body and cap housings and in fluid communication with said front end heat exchanger for receiving the refrigerant from said front end heat exchanger in the heating mode and for sending the refrigerant to said front end heat exchanger in the cooling mode;

a second refrigerant port defined within one of said body and cap housings and in fluid communication with said passenger compartment heat exchanger for sending the refrigerant to said passenger compartment heat exchanger in the heating mode and for receiving the refrigerant from said passenger compartment heat exchanger in the cooling mode; and a reversing valve disposed in said cap housing and being moveable therein between a first position associated with the heating mode where said first refrigerant port is isolated from said accumulator inlet such that the refrigerant from said compressor flows in the first direction to said passenger compartment heat exchanger first and then through said front end heat exchanger, and a second position associated with the cooling mode where said first refrigerant port is in fluid communication with said accumulator inlet such that the refrigerant from said compressor flows in the second direction to said front end heat exchanger first and then through said passenger compartment heat exchanger.

* * * * *